United States Patent [19]

Foshee et al.

[11] Patent Number: 4,655,063

[45] Date of Patent: Apr. 7, 1987

[54] PICK-RESISTANT CORE

[75] Inventors: William R. Foshee, Indianapolis; John P. McCrory, Carmel, both of Ind.

[73] Assignee: Best Lock Corporation, Indianapolis, Ind.

[21] Appl. No.: 736,145

[22] Filed: May 20, 1985

[51] Int. Cl.[4] ..... E05B 15/14

[52] U.S. Cl. ..... 70/419; 70/364 A; 70/378

[58] Field of Search ..... 70/419, 364 A, 375, 70/378

[56] References Cited

U.S. PATENT DOCUMENTS

| | | | |
|---|---|---|---|
| 563,867 | 7/1896 | Moser | 70/364 A |
| 621,875 | 3/1899 | Voight . | |
| 899,955 | 9/1908 | Collins . | |
| 2,049,548 | 8/1936 | Swanson . | |
| 2,051,772 | 8/1936 | Turrell . | |
| 2,059,129 | 10/1936 | Maxwell et al. | 70/378 |
| 2,111,098 | 3/1938 | Segal | 70/364 A |
| 2,121,301 | 6/1938 | Ractliffe . | |
| 2,179,947 | 11/1939 | Miller . | |
| 2,202,329 | 5/1940 | Braune | 70/419 |
| 2,283,489 | 5/1942 | Crousore | 70/419 |
| 2,294,495 | 9/1942 | Woodruff . | |
| 2,596,720 | 5/1952 | Pastor et al. . | |
| 2,629,249 | 2/1953 | Mendelsohn | 70/419 |
| 2,687,640 | 8/1954 | Mir et al. | 70/364 A |
| 3,286,494 | 11/1966 | Sussina . | |
| 3,303,678 | 2/1967 | Bernard et al. | 70/375 |
| 3,395,558 | 8/1968 | Russell et al. . | |
| 3,531,959 | 10/1970 | Weber . | |
| 3,605,462 | 9/1971 | Hermann | 70/419 |
| 3,762,193 | 10/1973 | Hucknall | 70/378 |
| 3,943,739 | 3/1976 | Genakis | 70/375 |
| 4,068,508 | 1/1978 | Genakis | 70/419 |
| 4,068,509 | 1/1978 | Genakis | 70/419 |
| 4,151,731 | 5/1979 | Tucker | 70/419 |
| 4,577,479 | 3/1986 | Widen | 70/419 |

FOREIGN PATENT DOCUMENTS

| | | |
|---|---|---|
| 572257 | 11/1958 | Belgium . |
| 449029 | 7/1936 | United Kingdom . |

*Primary Examiner*—Thomas J. Holko
*Assistant Examiner*—Suzanne L. Dino
*Attorney, Agent, or Firm*—Barnes & Thornburg

[57] ABSTRACT

A lock according to the present invention includes an interchangeable core including a core body, a core sleeve, and a key plug having a key slot. A sloping shoulder is provided on at least one of the tumbler pin passageways in the key plug to define an enlarged opening on the exterior surface of the key plug that is non-concentric with said passageway. A sloping shoulder can also be provided on at least one of the tumbler pin passageways in the core sleeve to define an enlarged opening on the exterior surface of the core sleeve that is non-concentric with said passageway.

18 Claims, 4 Drawing Figures

PICK-RESISTANT CORE

This invention relates to lock construction and particularly to a high security lock core. More particularly, this invention relates to the construction of a lock core for use in a lockset to improve the pick resistance of the assembly and reduce its vulnerability to destructive physical attack by forcing a lock-attacker to use an arbitrary picking sequence which cannot be planned in advance of an attack on the lock core.

A conventional lock cylinder assembly includes a threaded cylinder housing which screws directly into the lock case and an interchangeable key removable lock core of "Figure-8" construction removably mounted within the cylinder housing. Typically, such a lock cylinder is mounted in a mortise lock case for use in a mortise lockset. A key removable lock core typically includes a central core sleeve mounted for limited rotation in the lock cylinder housing between a core-retaining position and a core-releasing position, and a key plug mounted for rotation within the core sleeve between a locked position and an unlocked position. The core sleeve is typically rotatable through an angle of 15° in a clockwise direction to its core-releasing position by means of a control key to permit the lock core to be removed from the cylinder housing for recombinating or the like. The key plug is fully rotatable to its unlocked position by means of an operating key to activate a lock actuating cam mounted on the cylinder housing to activate the locking mechanism of the mortise lockset. A "control" shearline is defined at the interface between the lock cylinder housing and the central core sleeve, and an "operating" shearline is defined at the interface between the core sleeve and the key plug.

Notwithstanding the foregoing known lock features, the security of conventional locks can be violated in many different ways. Several commonly known lock-picking techniques are explained in the following paragraphs. The improved lock core of the present invention is specifically constructed to include several advantageous features which cooperate to frustrate the efforts of a lock-attacker who attempts to break the security of the improved lock using, for example, one of the following techniques.

One way to violate the security of a conventional lock is to pick the key plug. This type of picking is accomplished by inserting a tension device into the key slot formed in the key plug, torquing the tension device to rotate the plug so that the pin segment barrel in the plug is out of alignment with the pin segment barrel of the sleeve to define a first small arcuate shoulder or ledge along the "operating" shearline, inserting a picking tool into the key slot, lifting in a pin stack the first spring-loaded pin segment to manipulate the pin segment stack about the "operating" shearline shoulder until the lock-picker hears a click or pop or feels a slight movement of the key plug indicating that the pin segment stack is positioned with a shear break at the "operating" shearline, and repeating the foregoing procedure. The procedure is repeated for the spring-loaded pin segment stacks in each of the succeeding pin segment barrels of the key plug until all such pin segments have been manipulated to align all of the shear brakes with the "operating" shearline to permit the lock-picker to violate the security of the lock by further rotating the key plug within the core sleeve to operate the lock actuating cam.

Another way to violate the security of a conventional lock is to pick the central core sleeve. This method can be used if there is a sufficiently tight fit between the key plug and the surrounding core sleeve. This type of picking can be accomplished by inserting a resilient tension device into the key slot, torquing the tension device to rotate an assembly comprising the key plug and the surrounding core sleeve so that the pin segment barrels in the sleeve are out of alignment with the pin segment barrels of the lock cylinder housing to define a plurality of second small arcuate shoulders or ledges along the "control" shearline, inserting a picking tool into the key slot, lifting the first spring-loaded pin segment in a pin stack to manipulate the pin segment stack about the "control" shearline until the lock-picker hears a click or pop indicating that the pin segment stack is positioned with a shear break at the "control" shearline, and repeating the foregoing procedure. The procedure is repeated for the spring-loaded pin segment stacks in each of the succeeding pin segment barrels of the key plug until all such pin segments have been manipulated to align all of the shear brakes with the "control" shearline to permit the lock-picker to further rotate the core sleeve within the lock cylinder housing to its core-releasing position so that the entire interchangeable Figure-8 lock core is removable from the lock cylinder housing to permit manual actuation of the lock's throw member.

Violation of the security of a lock core by picking the key plug or the core sleeve is a serious problem. It has not been heretofore appreciated in the art that the above-described security problem is caused, in part, by provision of a lock core that permits a lock-attacker to use a regular sequence of picking operations to defeat the lock.

One object of the present invention is to provide a lock that will resist aligning of the tumblers and barrels within the key plug and being opened by means of picking tools.

Another object of the present invention is to provide a lock that is constructed to hinder the use of a regular sequence of picking operations and require instead an arbitrary sequence of picking operations to delay and otherwise frustrate the efforts of a lock-attacker.

The present invention provides a remedy to the previously unappreciated cause of the above-identified problem by using a unique pattern of bevels on the pin segment bores in the lock core. The present lock core is designed and constructed so that a segment pin holding shelf or ledge is not easily created at either the "control" or "operating" shearline in response to rotation of the key plug or the plug/sleeve assembly by a torquing or tension device inserted into the key slot of the key plug. In particular, eccentric bevels are formed at the outer end of the pin bores of the key plug at the operating shearline and of the core sleeve at the control shearline in a unique pattern with some of the bevels at one side and others at the opposite side of the line of pin bores. The pattern may either be a predetermined or a random pattern. The purpose is to hinder the use of a regular sequence of picking operations and require instead an arbitrary sequence, depending upon the pattern in which the bevels are located.

According to the present invention, a lock comprises an interchangeable lock core including a core body, a core sleeve, and a key plug having a key slot. The core body includes a chamber for receiving the core sleeve and the key plug, and a plurality of tumbler pin bores extending from the chamber. The core sleeve is received in the core chamber for limited rotation. The sleeve includes a plurality of tumbler pin passageways extending through the sleeve to an exterior surface thereof. The tumbler pin passageways of the sleeve are alignable with the tumbler pin bores of the core body. At least one of said sleeve passageways has a sloping shoulder or bevel defining an enlarged opening on the exterior surface of the sleeve.

The key plug is received within the core sleeve for full rotation. The key plug includes a plurality of tumbler pin passageways extending from the key slot to an exterior surface of the key plug. The tumbler pin passageways of the key plug are alignable with the tumbler pin passageways of the sleeve and also with the tumbler pin bores of the core body. At least one of said key plug passageways has a sloping shoulder or bevel defining an enlarged opening on the exterior surface of the key plug.

One feature of the present invention is the provision of a sloping shoulder or bevel on at least one of the tumbler pin passageways in the key plug to define an enlarged opening on the exterior surface of the key plug. The enlarged opening is advantageously situated along the "operating" shearline of the improved lock. Rotation of the improved key plug of the present invention by means of a tension device no longer creates a segment pin holding shelf or ledge at the "operating" shearline of the type on which a segment pin can easily be placed by a picking tool. Rather, a segment pin that has been lifted above the "operating" shearline and then released will be exposed to the novel sloping shoulder of the improved key plug and will be cammed downwardly into its original position within the pin segment barrel. Thus, one attacking the improved lock of the present invention can no longer easily pick the lock by hanging the pin segments on the "operating" shearline for the purpose of the key plug to rotate to operate the lock. It will be understood that said sloping shoulders can be randomly or systematically formed in one or more of the key plug barrels on the same side or alternate sides thereof.

Another feature of the present invention is the provision of a sloping shoulder or bevel on at least one of the tumbler pin passageways in the core sleeve to define an enlarged opening on the exterior surface of the core sleeve. The enlarged opening is advantageously situated along the "control" shearline of the improved lock. Rotation of the plug/sleeve assembly by means of a tension device no longer creates a segment pin holding shelf or ledge at the "control" shearline on which a pin segment can be placed by a picking tool. Rather, a segment pin that has been lifted above the "control" shearline and then released will be exposed to the unique sloping shoulder of the core sleeve and will be cammed downwardly into its original locked position within the pin segment barrel. Thus, it is considerably more difficult to pick the improved lock of the present invention by hanging the pin segments on the "control" shearline for the purpose of removing the core sleeve and key plug from the core body. It will be appreciated that said sloping shoulders can be randomly or systematically formed in one or more of the key plug barrels along one side thereof. It is within the scope of the present invention to provide sloping shoulders on alternate sides of the sleeve barrels; however, it is only necessary to position said shoulders along the side of the sleeve opposite the direction of rotation since typically a core sleeve, unlike a key plug, is able to rotate in only one direction.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which:

FIG. 2 is a transverse section of the lock core illustrated in FIG. 1 showing a pin segment being cammed downwardly on a sloping surface of the key plug into the key slot in response to rotation of the key plug by means of a tension device or the like;

Figure 1:
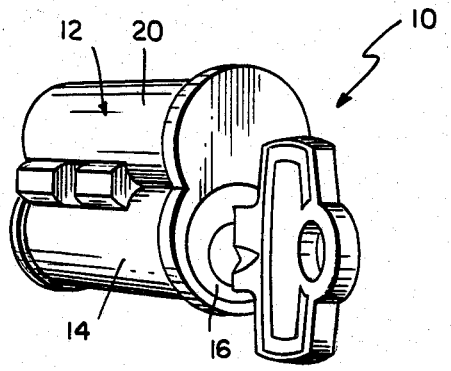
FIG. 1 is a perspective view of an interchangeable lock core embodying the present invention.
Figure 2:
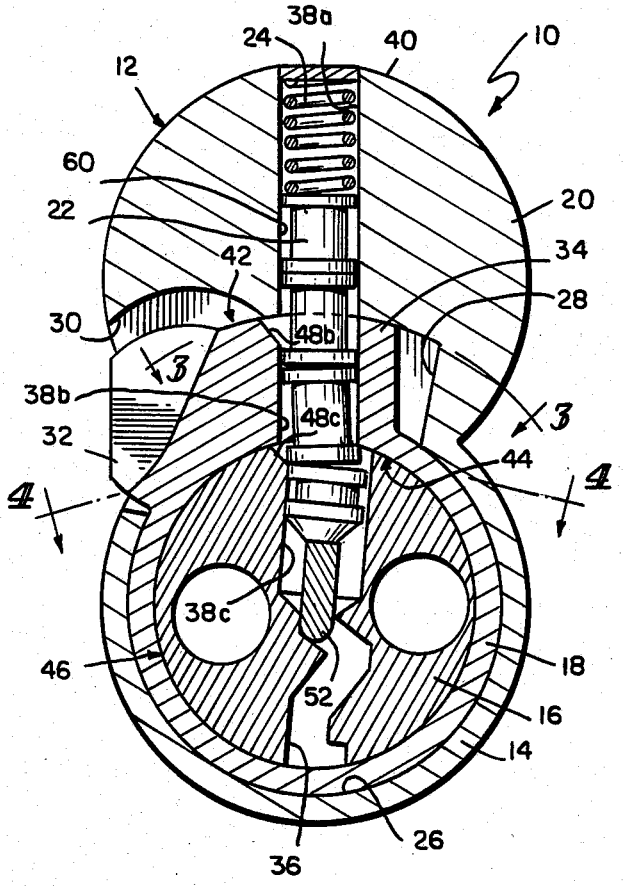

An interchangeable lock core 10 is illustrated in FIG. 1. The interchangeable core 10 includes a core body 12. The core body 12 is desirably of figure-8 cross-section. It is within the scope of the present invention to use a different type of lock core. Referring now to FIG. 2, core body 12 has a lower lobe 14 which contains a key plug 16 and a core sleeve 18, and an upper lobe 20 which contains the pin tumblers or segments 22 and their biasing springs 24. The core body 12 is adapted to be mountable in a lock cylinder housing (not shown).

As shown best in FIG. 2, the lower lobe 14 of the core body 12 is formed with a cylindrical bore 26 in which the thin-walled core sleeve 18 is mounted for limited rotation. The bore 26 is in open communication with a wide fantail slot 28 formed in the upper lobe 20. At the rear of the core body 12, the side wall of the slot 28 is milled away to provide surface 30 to pass a core-retaining lug 32 which is formed integral with a boss 34 on the core sleeve 18. The limited rotation of the core sleeve 18 moves the retaining lug 32 between a projected, core-retaining position as shown in FIG. 2 and a retracted, core-releasing position (not shown).

The key plug 16 comprises a cylindrical body portion, desirably made from solid stock, which extends completely through the core sleeve 18 and has a close working fit within that sleeve. The key plug 16 is formed with an axial broached key slot 36. The key plug 16 is rotatably mounted within the core sleeve 18.

The pin tumblers or segments 22 are movable within pin tumbler bores that extend downward from the top of the upper lobe 20 through that lobe 20 on through the boss 34 on the core sleeve 18 and into the key slot 36 of the key plug 16. In particular, the core body 12 includes a plurality of bores **38*a* extending between an exterior surface 40 of the upper lobe 20 and the wide fantailed slot 28. The core sleeve 18 is formed to include a like plurality of tumbler pin passageways 38*b* extending between an exterior surface 42 of the boss 34 and an interior cylindrical surface 44 of the core sleeve 18. The key plug 16 is formed to include a like plurality of tumbler pin passageways 38*c* extending between an exterior surface 46 of the key plug 16 and the key slot 36. The tumbler pin passageways 38*b* and 38*c* are desirably of the same diameter and are alignable with the tumbler pin bore 38*a* in the core plug 16**.

The outer end of tumbler pin passageways 38b and 38c are beveled in the present invention to provide a lock that will resist picking at both the operating and control shearline. Moreover, the bevels are arranged in a unique pattern (e.g. alternate sides, or randomly selected sides) to hinder the use of a regular sequence of picking operations and require instead an arbitrary sequence depending upon the pattern in which the bevels are located. The bevels are formed on both the core sleeve 18 and the key plug 16 to improve the security of the novel lock core 12 of the present invention.

Figure 3:
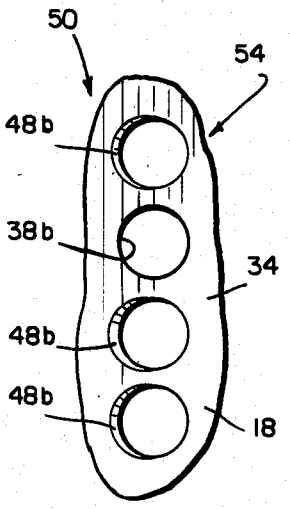
FIG. 3 is an enlarged top plan view of the countersunk sloping shoulders of the tumbler pin passageways of the core sleeve taken along lines 3—3 of FIG. 2.

The boss 34 of the core sleeve 18 includes a sloping shoulder 48b defining an enlarged opening on the exterior surface 42 of the core sleeve 18 as shown in FIG. 2. In a preferred embodiment illustrated in FIG. 3, the sloping shoulders 48b are formed on only one side 50 of boss 34 opposite the direction of rotation of retaining lug 32 to its core-retaining position. The sloping shoulders 48b improve the pick resistance of the lock by making it more difficult for a lock-attacker to hang the pin segments 22 on the "control" shearline for the purpose of removing the core body 12 from its lock cylinder housing (not shown). The sloping shoulders or depressions 48b cause pin segments 22 to be funneled downwardly toward the key slot 36 even if the tumbler pin passageway 38b of the core sleeve 18 and the tumbler pin passageway 38c of the key plug 16 are slightly misaligned in response to rotation of the key plug 16 and core sleeve 18 within the core body 12 by means of a flexible torquing bar or tension device 52 inserted into the key slot 36. Although it is within the scope of the present invention to form sloping shoulders 48b on the other side 54 of boss 34, it will be understood that such a placement would generally not beneficially prevent the formation of pin segment holding shelves or ledges unless the core sleeve 18 was free to rotate in the direction of rotation of retaining lug 32 past its core-releasing position and away from its core-retaining position.

The sloping shoulders 48b are formed by drilling an offset countersink at the appropriate tumbler pin passageway opening. Each sloping shoulder 48b defines an enlarged opening that is non-concentric with the corresponding tumbler pin passageway 38b. Thus, each sloping shoulder 48b is offset in a first direction. A random or systematic process can be employed to determine which passageway openings among the total number of such openings will be countersunk to provide the sloping shoulders 48b. Desirably, such selection will vary among all locks constructed in accordance with the teaching of the present invention to confuse and frustrate one trying to violate the security of the present lock by forcing the lock-attacker to pick the lock in a certain unknown sequence.

Figure 4:
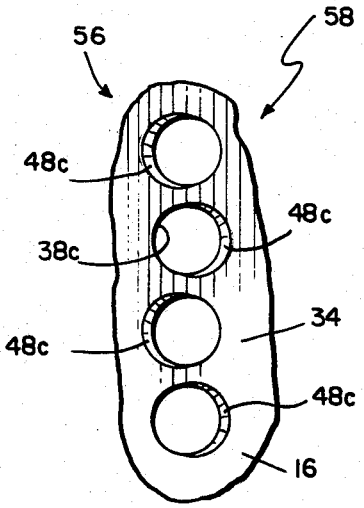
FIG. 4 is an enlarged top plan view of the countersunk sloping shoulders of the tumbler pin passageways of the key plug taken along lines 4—4 of FIG. 2.

The key plug 16 also includes a sloping shoulder 48c defining an enlarged opening on the exterior surface 46 of the key plug 16 as best shown in FIGS. 2 and 4. In a preferred embodiment illustrated in FIG. 4, the sloping shoulders 48c are formed on alternate sides 56, 58 of the line of tumbler pin passageways 38c on the key plug 16. In contrast to the foregoing case of the core sleeve 18; it is desirable to place at least one countersunk sloping shoulder 48c on one side 56 and at least one countersunk sloping shoulder 48c on the other side 58 since the key plug 16 is rotatable by means of the tension device 52 in both clockwise and counterclockwise directions. Such a novel alternating arrangement will improve the security of the lock by forcing a lock-attacker to use the tension device 52 to rotate the key plug 16 in a different direction as each succeeding pin segment 22 is picked. The novel structure of the present invention thus delays the lock-attacker during a pick. Shoulders 48c are formable in the same manner as shoulders 48b. The sloping shoulders 48c improve the pick reistance of the lock by making it more difficult for a lock-attacker to hang the pin segments 22 on the "operating" shear line for the purpose of removing the key plug 16 from the core body 12.

A random or systematic process can be employed to determine which passageway openings among the total number of such openings will be countersunk to provide the non-concentric sloping shoulders 48c. A random countersink arrangement still further delays a lock-attacker since it is unclear which direction the key plug 16 must be rotated for each pin segment barrel to pick the key plug 16. Although the lock-attacker may eventually deduce the countersink pattern for the lock being picked, he will require an extended period of time to do so. This time delay factor significantly improves the security of the lock by increasing the likelihood that the lock-attacker will be captured or otherwise frustrated.

"Spool" type pin segments 22 are used in selected pin segment barrels in the present invention to add false shear lines and thereby further improve the security of the lock. "Spool" type pins have an undercut to create false shearlines and thereby improve the pick resistance of the lock. However, in a preferred embodiment of the present invention, spool pins are not used exclusively since it is possible to imagine a combination where all of the spools would be situated on a shear line enabling the key plug 30 to be rotated through an undesirably large angle. Thus, it is desirable to place hardened stainless steel solid unspooled pins (not shown) in the first or forwardmost barrel 60 (See FIG. 1). Hardened stainless steel spooled pins are placed in the next two succeeding barrels (not shown) so that the first three barrels have hardened pins to better resist attack as by drilling. The remainder of the pins are spooled, but are not necessarily hardened.

Although the invention has been described in detail with reference to certain preferred embodiments and specific examples, variations and modifications exist within the scope and spirit of the invention as described and defined in the following claims.

What is claimed is:

1. A lock comprising a core body formed to include a chamber for receiving at least a key plug and a plurality of tumbler pin bores extending from the chamber, a plurality of downwardly-biased tumbler pins received in each tumbler pin bore, and a key plug having a cylindrical exterior surface defining an annular shearline, the key plug being rotatably received in the chamber and formed to include a key slot and a plurality of first tumbler pin passageways extending from the slot toward the cylindrical exterior surface of the key plug for alignment with the tumbler pin bores of the core body, the tumbler pin bores of the core body being substantially the same diameter as the first tumbler pin passageways of the key plug, one tumbler pin being arranged to position its lowermost edge at about the annular shearline, at least one of the first passageways having a first radially inwardly sloping shoulder extending between the cylindrical exterior surface of the key plug and the at least one of the first passageways to intersect the annular shearline and defining an enlarged opening on the exterior surface of the key plug that is non-concentric with a companion first tumbler pin passageway, each first radially inwardly sloping shoulder being configured to face the lowermost edge of a companion said one tumbler pin in response to rotation of the key plug through about a predetermined arc in relation to the core body during a lock-picking attack so that the lowermost edge of said companion tumbler pin is cammed in a radially inward direction along the underlying first radially inwardly sloping shoulder into its first tumbler pin passageway to a point below the annular shearline during downward movement of said companion tumbler pin to inhibit further rotation of the key plug to a lock-actuating position.

2. The lock of claim 1 wherein a plurality of randomly selected first tumbler pin passageways have a sloping shoulder.

3. The lock of claim 1 wherein a plurality of selected first tumbler pin passageways have a sloping shoulder, at least one of said first selected passageways having its enlarged opening offset in a first direction, and at least another one of said selected first passageways having its enlarged opening offset in a second direction opposite the first direction.

4. The lock of claim 1 further comprising a sleeve rotatably received in the chamber, the sleeve being formed to include a key plug chamber for receiving the key plug and a plurality of second tumbler pin passageways extending from the key plug chamber to an exterior surface of the sleeve for alignment with the tumbler pin bores of the core body and the first tumbler pin passageways of the key plug, at least one of the second passageways having a second radially inwardly sloping shoulder defining an enlarged opening on the exterior surface of the sleeve, that is non-concentric with the second tumbler pin passageway.

5. The lock of claim 4 wherein a plurality of randomly selected second tumbler pin passageways have a sloping shoulder.

6. The lock of claim 1, wherein each first radially inwardly sloping shoulder is substantially crescent-shaped.

7. The lock of claim 3, wherein the enlarged opening of each first radially inwardly sloping shoulder defines a crescent-shaped offset bevel region.

8. A lock comprising a core body formed to include a chamber for receiving at least a key plug and a plurality of tumbler pin bores extending from the chamber, a plurality of downwardly-biased tumbler pins received in each tumbler pin bore, and a key plug rotatably received in the chamber and formed to include a key slot and a plurality of first tumbler pin passageways extending from the slot to an exterior surface of the key plug for alignment with the tumbler pin bores of the core body, the tumbler pin bores of the core body being substantially the same diameter as the first tumbler pin passageways of the key plug, at least one of the first passageways having sloping cam shoulder means for camming a lowermost tumbler pin in a radially inward direction into its companion first tumbler pin passageway to block rotation of the key plug to a lock-actuating position, each sloping cam shoulder means being offset in asymmetric relation to its companion first tumbler pin passageway.

9. The lock of claim 8, wherein each sloping cam shoulder of the first tumbler pin passageway is substantially crescent-shaped.

10. The lock of claim 8, wherein a plurality of randomly selected first tumbler pin passageways have a sloping cam shoulder.

11. The lock of claim 8, wherein a plurality of selected first tumbler pin passageways have a sloping cam shoulder, at least one of said first selected passageways having an enlarged opening on the exterior surface offset in a first direction, and at least another one of said selected first passageways having an enlarged opening on the exterior surface offset in a second direction opposite the first direction.

12. The lock of claim 11, wherein the enlarged opening of each sloping cam shoulder defines a crescent-shaped offset bevel region.

13. The lock of claim 8, further comprising a sleeve rotatably received in the chamber, the sleeve being formed to include a key plug chamber for receiving the key plug and a plurality of second tumbler pin passageways extending from the key plug chamber to an exterior surface of the sleeve for alignment with the tumbler pin bores of the core body and the first tumbler pin passageways of the key plug, at least one of the second passageways having a sloping cam shoulder for camming a tumbler pin situated in the tumbler pin bore above the lowermost tumbler pin from its position within the tumbler pin bore into its companion second tumbler pin passageway to block rotation of the sleeve to a core-releasing position.

14. The lock of claim 13, wherein each sloping cam shoulder of the second tumbler pin passageway is substantially crescent-shaped.

15. The lock of claim 13, wherein a plurality of randomly selected second tumbler pin passageways have a sloping shoulder.

16. A lock comprising a core body formed to include a chamber for receiving at least a key plug and a plurality of tumbler pin bores extending from the chamber, a plurality of tumbler pins received in each tumbler pin bore, and a key plug rotatably received in the chamber and formed to include a key slot and a plurality of first tumbler pin passageways extending from the slot to an exterior surface of the key plug for alignment with the tumbler pin bores of the core body, the tumbler pin bores of the core body being substantially the same diameter as the first tumbler pin passageways of the key plug, at least one of the first passageways being configured to define offset means for guiding the lowermost tumbler pin into its companion first tumbler pin passageway following rotation of said first tumbler pin passageway to a position out of alignment with its companion tumbler pin bore without supporting said lowermost tumbler pin on the key plug so that further rotation of the key plug to a lock-actuating position is substantially blocked, the offset means including a first radially inwardly sloping shoulder extending between an exterior surface of the key plug and at least one of the first passageways and defining an enlarged opening on the exterior surface of the key plug that is non-concentric with the first tumbler pin passageway and defines a substantially crescent-shaped offset bevel region.

17. A lock comprising a core body formed to include a chamber for receiving at least a key plug and a plurality of tumbler pin bores extending from the chamber, and a key plug rotatably received in the chamber and formed to include a key slot and a plurality of first tumbler pin passageways extending from the slot to an exterior surface of the key plug for alignment with the tumbler pin bores of the core body, the tumbler pin bores of the core body being substantially the same diameter as the first tumbler pin passageways of the key plug, a plurality of selected first tumbler pin passageways having a radially inwardly sloping shoulder defining an enlarged opening on the exterior surface of the key plug that is non-concentric with the first tumbler pin passageway, at least one of said first selected passageways having its enlarged opening offset in a first direction, and at least another one of said selected first passageways having its enlarged opening offset in a second direction opposite the first direction.

18. The lock of claim 17, wherein a plurality of randomly selected first tumbler pin passageways have a sloping cam shoulder.

* * * * *